United States Patent [19]

Peters

[11] 4,380,833

[45] Apr. 26, 1983

[54] DOLL DRESS AND CRENELLE

[76] Inventor: Sherry Peters, R.R. 3, Box 425, Chesterton, Ind. 46304

[21] Appl. No.: 297,778

[22] Filed: Aug. 31, 1981

[51] Int. Cl.[3] ..... A41D 1/22

[52] U.S. Cl. ..... 2/105; 46/115

[58] Field of Search ..... 2/243 B, 105, 74, 216, 2/217, 212; 46/115

[56] References Cited

U.S. PATENT DOCUMENTS 2,436,060 2/1948 Trokie et al. ..... 2/243 B 2,528,639 11/1950 Clayton ..... 2/216

*Primary Examiner*—Doris L. Troutman

*Attorney, Agent, or Firm*—Walter Leuca

[57] ABSTRACT

A doll dress constructed by providing a strip of net material gathered on a cord and sewn to the inside of the dress circumferentially of the hem thereof. The strip has a width of approximately ⅓ the length of the skirt portion and is approximately 30 times longer than the circumferential length of the skirt at the hem portion thereof. The strip is gathered on the cord to the circumferential length of the hem portion of the skirt to give a desirable billowy appearance and provide a flexible base for maintaining the doll upright on an uneven or unstable surface.

6 Claims, 4 Drawing Figures

DOLL DRESS AND CRENELLE

BACKGROUND OF THE INVENTION

1. Field of the Invention

This invention relates generally to a doll dress and more particularly to a method of constructing a crenlin to give the appearance of a multiplicity of petticoats underneath the doll dress.

2. Description of the Prior Art

Many prior art dolls are provided with feet constructed so that the doll may stand up unaided. Other dolls are provided with a stand or base on which the dolls' feet are fixed by which means the doll is maintained upright. In either case the supporting surface must be level. Surfaces which are not level or are unstable such as beds and couches, do not provide the type of surface on which dolls could be maintained upright with stability. Therefore, it would not be possible to decorate a bed or couch with a doll since such surfaces would not be suitable for maintaining such dolls upright.

SUMMARY OF THE INVENTION

Accordingly, the object of this invention is to provide a dress for a doll which gives the appearance of having a multiplicity of petticoats and also serves as a base to support the doll in an upstanding position on any type of surface.

Other objectives and advantages will become apparent after a careful study of the following detailed description taken with reference to the accompanying drawings wherein is illustrated a preferred embodiment of my invention.

DETAILED DESCRIPTION OF THE INVENTION

Figure 1:
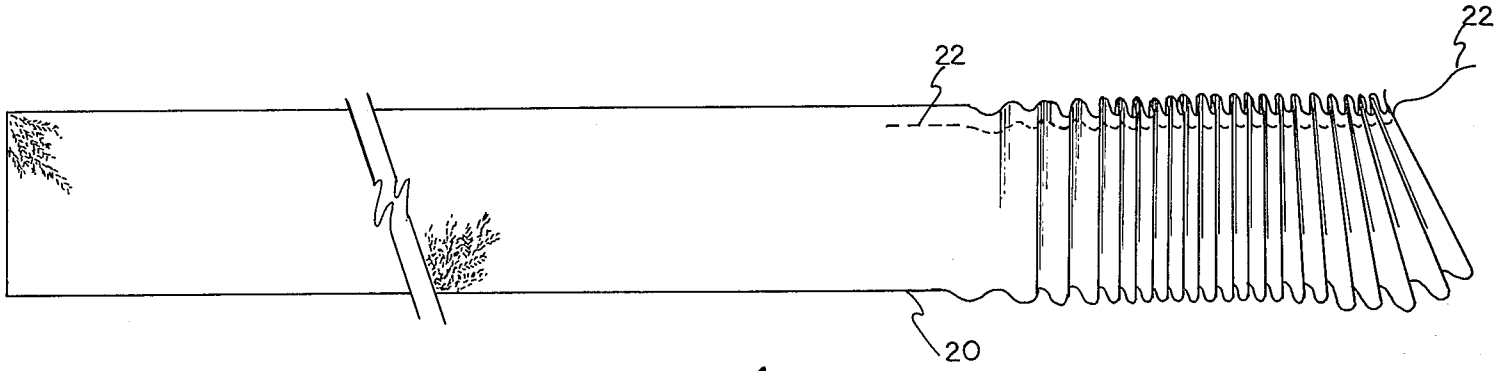
FIG. 1 is a longitudinal elevation of the strip of net material shown partly gathered on a cord according to my invention.
Figure 2:
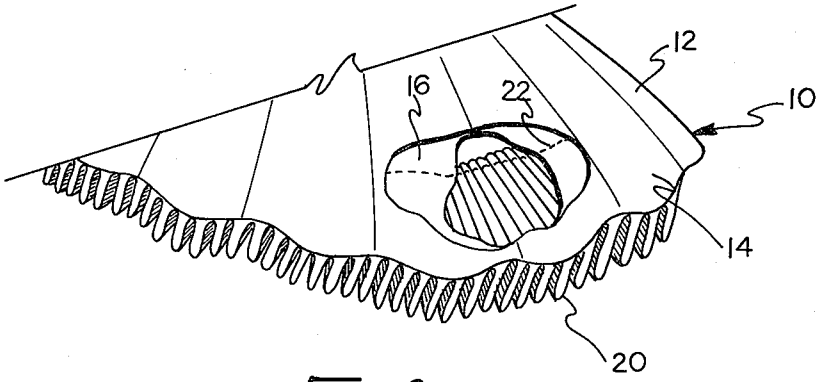
FIG. 2 is a diagramatic fragment of the doll dress and slip, partly broken away showing the strip of gathered net material sewn to the inside of the slip along the hem portion thereof.
Figure 3:
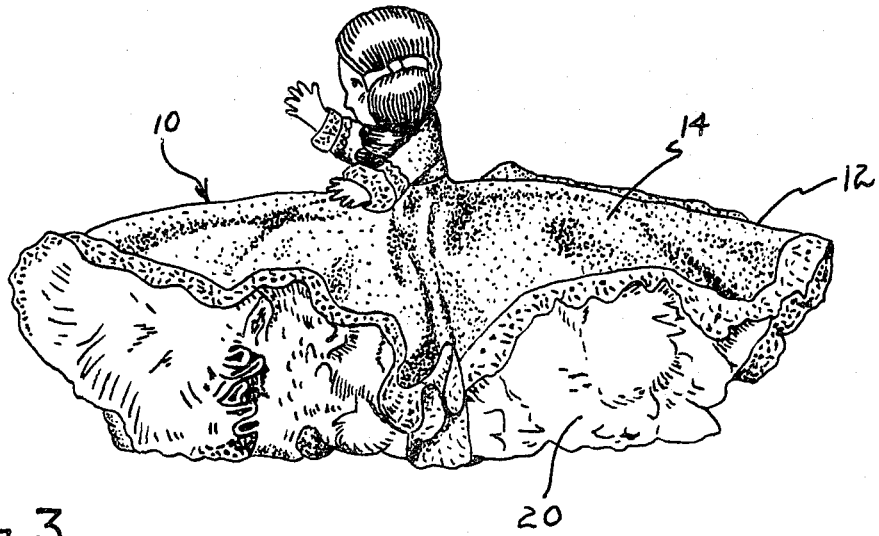
FIG. 3 is a side view of the doll dress of my invention.
Figure 4:
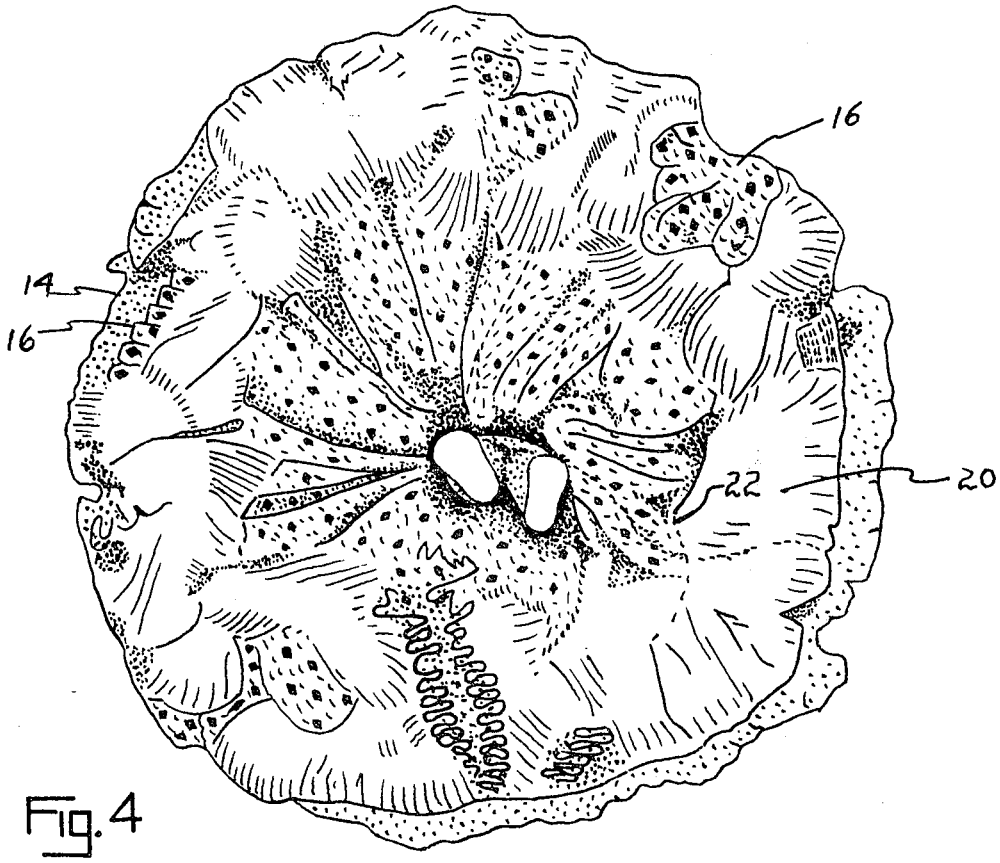
FIG. 4 is a bottom view thereof.

Referring now more particularly to the drawings, numeral 10 designates in general my invention. It comprises a doll dress 12 having a full length skirt 14 overlaying a full length slip 16. The inside of slip 16 has sewn thereto circumferentially of the hem thereof, a strip 20 of net material. In order to provide the billowy appearance characteristic of a multiplicity of petticoats as shown in FIG. 3, and to provide a flexible base for the doll. I have found that critical dimensions are to be observed in constructing the doll dress of my invention in order to give it a pleasing and authentic appearance, and provide a stable base.

I have found that for the style depicted by the drawing wherein the skirt and slip length, for example, 10 inches, the circumferential dimension of the hem portion of the dress and slip should be approximately 2 yards. For these dimensions, I provide a strip 20 of net material 3 inches wide and approximately 180 feet long. In order to sew gathered strip 20 on the interior of slip 16, I stitch a thread or cord 22 along the longitudinal edge of strip 20 the length thereof with appropriate stitch spacing so that the net material of strip 20 may be gathered to a length of 6 feet. The strip 20 of gathered net material is sewn along cord 22 to the inside of slip 16 circumferentially of the hem thereof.

I have found that these approximate dimensions, when expressed in ratios provide an appealing doll dress with a billowy, ruffled undergarment characteristic of a dress of the type illustrated, and since many people prefer to decorate their beds and couches with dolls, the dress of my invention provides a flexible base on which the doll may be maintained upright on a bed or couch surface.

Accordingly, I have found that doll dresses of a variety of sizes may be constructed by providing a strip 20 of net material having a width approximately $\frac{1}{3}$ of the slip and approximately 30 times the circumferential length of the slip at the hem portion thereof, to give the desired appearance and utility of this invention.

I claim:

1. A doll dress comprising:

a full length skirt portion;

a strip gathered on a cord stitched along a longitudinal side of said strip, said strip being sewn on said skirt portion around the hem portion thereof, said strip having a width of approximately $\frac{1}{3}$ the length of said skirt;

said strip having a longitudinal length approximately 30 times the circumferential length of said skirt along the hem thereof, and gathered on said cord to equal the circumferential length of said skirt at the hem portion thereof.

2. The doll dress of claim 1 wherein said strip is further characterized as being formed from net material.

3. The doll dress of claim 1 wherein said strip is further characterized as being sewn on the inside of said skirt portion.

4. A doll dress comprising:

a full length skirt portion;

a slip underlaying said skirt portion;

a strip gathered on a cord stitched along a longitudinal side of said strip, said strip being sewn on said slip circumferentially around the hem portion thereof, said strip having a width of approximately $\frac{1}{3}$ the length of said slip;

said strip having a longitudinal length approximately 30 times the circumferential length of said slip along the hem thereof, and gathered on said cord to equal the circumferential length of said slip at the hem portion thereof.

5. The doll dress of claim 4 wherein said strip is further characterized as being formed from net material.

6. The doll dress of claim 4 wherein said strip is further characterized as being sewn on the inside of said slip.

* * * * *